US008208678B2

(12) United States Patent
Mundorf

(10) Patent No.: US 8,208,678 B2
(45) Date of Patent: Jun. 26, 2012

(54) MEMBRANE OR MEMBRANE CONFIGURATION FOR AN ELECTRODYNAMIC SOUND TRANSDUCER, AND LOUDSPEAKER COMPRISING SUCH A MEMBRANE OR MEMBRANE CONFIGURATION

(75) Inventor: Raimund Mundorf, Köln (DE)

(73) Assignee: Mundorf EB GmbH, Cologne (DE)

( * ) Notice: Subject to any disclaimer, the term of this patent is extended or adjusted under 35 U.S.C. 154(b) by 298 days.

(21) Appl. No.: 12/610,740

(22) Filed: Nov. 2, 2009

(65) Prior Publication Data

US 2010/0098271 A1 Apr. 22, 2010

Related U.S. Application Data

(63) Continuation of application No. PCT/EP2008/003517, filed on Apr. 30, 2008.

(30) Foreign Application Priority Data

May 2, 2007 (DE) ..... 10 2007 020 847

(51) Int. Cl.
*H04R 7/14* (2006.01)

(52) U.S. Cl. ..... 381/398; 381/190

(58) Field of Classification Search ..... 381/190, 381/398, 431
See application file for complete search history.

(56) References Cited

U.S. PATENT DOCUMENTS

| | | | | |
|---|---|---|---|---|
| 3,636,278 | A | 1/1972 | Heil | |
| 4,056,697 | A | 11/1977 | Heil | |
| 6,111,970 | A * | 8/2000 | Voishvillo et al. | 381/398 |
| 6,831,985 | B2 * | 12/2004 | Takei | 381/190 |

FOREIGN PATENT DOCUMENTS

| | | |
|---|---|---|
| DE | 2 003 950 | 9/1970 |
| DE | 202 07 154 U1 | 9/2002 |
| GB | 287 065 | 1/1929 |
| JP | 59055699 A | 3/1984 |
| WO | 9820705 A1 | 5/1998 |
| WO | 01/13678 A1 | 2/2001 |

OTHER PUBLICATIONS

International Search Report, dated Sep. 10, 2008.

* cited by examiner

*Primary Examiner* — Davetta W Goins
*Assistant Examiner* — Amir Etesam
(74) *Attorney, Agent, or Firm* — Laurence A. Greenberg; Werner H. Stemer; Ralph E. Locher

(57) ABSTRACT

A membrane for an electrodynamic sound transducer, particularly a membrane for an AMT loudspeaker, has a meandering shape and is disposed in an air gap between two pole plates. The membrane has a plurality of opposite flanks and a plurality of wave crests and/or wave troughs. In order to avoid parasitic oscillations, at least one supporting element is provided which stabilizes the position and/or the orientation of at least one wave crest and/or wave trough.

14 Claims, 18 Drawing Sheets

MEMBRANE OR MEMBRANE CONFIGURATION FOR AN ELECTRODYNAMIC SOUND TRANSDUCER, AND LOUDSPEAKER COMPRISING SUCH A MEMBRANE OR MEMBRANE CONFIGURATION

CROSS-REFERENCE TO RELATED APPLICATION

This application is a continuation, under 35 U.S.C. §120, of copending international application PCT/EP2008/003517, filed Apr. 30, 2008, which designated the United States; this application also claims the priority, under 35 U.S.C. §119, of German patent application No. DE 10 2007 020 847.4, filed May 2, 2007; the prior applications are herewith incorporated by reference in their entirety.

BACKGROUND OF THE INVENTION

Field of the Invention

The invention relates to a membrane for an electrodynamic sound transducer, in particular a loudspeaker membrane for a loudspeaker, in particular for a planar emitter, preferably an AMT loudspeaker. The membrane—in the installed state—is of a substantially meandering design and can preferably be arranged in an air gap provided between two pole plates, wherein the membrane has a plurality of preferably opposing flank sides and a plurality of wave crests and/or wave troughs, and wherein conductor tracks are provided along the majority of the flank sides. The invention furthermore relates to a loudspeaker comprising such a membrane or membrane configuration.

A number of prior art documents, see for example, German published patent application DE 2 003 950 A1, describe membranes for electrodynamic sound transducers. Such membranes for electrodynamic transducers can be used in various sound transducers, for example in loudspeakers, but also in microphones, headsets and the like. The membrane thereby has membrane parts which can oscillate, namely opposing or adjacent flank sides, and wave crests and/or wave troughs connecting these flank sides, as a result of which narrow air pockets are formed due to this structure. These air pockets are alternately closed and opened to push out or suction in air, preferably for generating corresponding sound waves. To this end, the membrane has a functional connection to a suitable device. The membrane itself has conductor tracks along the flank sides, wherein the membrane is arranged in an applied magnetic or electrostatic field, preferably in an air gap between two pole plates. If electrical current, in particular appropriate alternating current signals, now passes through the conductor tracks, this can cause the flank sides to oscillate and so the air pockets formed by the flank sides are closed and opened so as to generate corresponding sound waves or sound pressure. Such membranes can therefore be used in loudspeakers; however, use in microphones or the like—namely the reverse case—is also feasible.

Such membranes and the functional principle thereof have already been disclosed in a variety of prior art documents, as mentioned above (see, for example, DE 202 07 154 U1 as well), as mentioned above, and such membranes are particularly used in so-called air motion transformer (AMT) loudspeakers (based on the developments by Dr. Oskar Heil). The basic principle is basically the same in each case, wherein a meander-shaped or accordion-like folded membrane is used, with conductor tracks being arranged thereon in a corresponding fashion. When arranged in a "permanent magnetic field," the membrane folds or the air pockets in the membrane close or open, preferably when an alternating current flows through the conductor tracks, wherein the air is pushed out of or suctioned into the air pockets. Due to the very small amounts of mass moved, so-called "air motion transformers" are distinguished by an excellent impulse property and a high efficiency. Air motion transformers are particularly used in hi-fi loudspeakers as high tone loudspeakers or tweeters for the frequency range from approximately 1 kHz to at most approximately 25 kHz.

FIG. 1 shows a schematic diagram of a membrane 1 already known from the prior art for an electrodynamic sound transducer (not shown in any more detail in this case), particularly in this case a loudspeaker membrane for a loudspeaker. The membrane 1 which in this case is of a meandering design basically assumes this position in its operational state, with it in this case preferably being arranged in an air gap between two pole plates. During production, the membrane is firstly processed as a planar element, wherein the corresponding conductor tracks 2 which can be recognized in this case are preferably formed on the membrane by means of appropriate known etching processes. A plurality of wave crests 3 and wave troughs 4 and the opposing flank sides 5, which connect the individual wave crests 3 or wave troughs 4 to one another and on which the conductor tracks 2 are provided as illustrated, can clearly be seen in this case. FIG. 1 clearly shows that a plurality of air pockets 6 are formed by this arrangement. Corresponding arrows in FIG. 1 indicate a current I flowing along the conductor tracks 2 and a magnetic field (illustrated by arrows B in this case), in particular an electrostatic magnetic field.

The method of operation of the membrane 1 known from the prior art is now first of all illustrated in particular in FIGS. 2 and 3 in a schematic fashion. While FIG. 1 shows the "normal position", FIGS. 2 and 3 show, for comparison, the corresponding movements of the membrane. To this end, FIGS. 2 and 3 now show, in solid lines, the state of the membrane 2 or the air pockets 6 as a function of the respectively different current directions and, respectively dashed in the illustration, the "normal position" of the membrane 1 when no current is flowing.

Thus, FIG. 2 shows for a first current direction that the side flanks 5 of the membrane 1 in each case move according to arrows $C_1$, depending on the direction of the current, namely such that in this case the widths of the air pockets 6*a*, 6*b*, 6*c* and 6*d* increase and so, in accordance with arrows E, air can correspondingly be suctioned into these air pockets 6*a* to 6*d*. By contrast, the air pockets 6*e*, 6*f* and 6*g* correspondingly reduce their width and so, in accordance with arrows A, the air is pushed out of these pockets. (Arrows A: air outflow, arrows E: air inflow).

FIG. 3 shows the membrane 1 and the movement thereof when the current direction illustrated in FIG. 2 is reversed, namely the flank sides 5 move in the correspondingly opposite direction according to arrows $C_2$. It can clearly be seen in this case that the air pockets 6*a*, 6*b*, 6*c* and 6*d* now narrow correspondingly, and so the air is pushed out of these pockets 6*a* to 6*d* (arrows A), and the air pockets 6*e*, 6*f* and 6*g* have expanded accordingly, and therefore the air is in this case accordingly suctioned into these air pockets 6*e*, 6*f* and 6*g* (arrows E).

Therefore, FIGS. 1 to 3 show the method of operation of a membrane 1 for an electrodynamic sound transducer known from the prior art. It becomes apparent that in the case of such membranes 1 the opposing flank sides 5 which respectively delimit an air pocket 6 now first of all move toward and then away from one another. The flank sides 5 respectively directly adjacent to the right and left of a particular air pocket thus always move in the opposite direction to these respective air pockets enclosed by the flank sides. This correspondingly narrows or expands the corresponding air pockets 6*a* to 6*g* and so the air located between the flank sides 5 is either pushed out or, in the case of the opposite motion, correspondingly suctioned in as a result of these movements, as illustrated in FIGS. 2 and 3.

However, investigations have now shown that the membrane also carries out a whole array of undesired additional movements in addition to the desired movement of the flank sides, namely, in particular, because the flank sides are simply not displaced laterally parallel to one another as is hoped for.

Thus, FIG. 4*a* firstly shows a schematic illustration of a section of a membrane, namely a wave crest 3, from above in a dashed illustration (rest position) and, during operation, the movement of the flank sides or the correspondingly moved wave crest "3" using full lines in the illustration. It can clearly be seen that the moved wave crest 3 in this case is curved, that is to say the lower and upper end regions are in each case deflected less in the lateral direction than the central region.

Thus, FIG. 4*b* shows in a very much simplified schematic illustration individual lines as the "axis lines of the wave crest tails 3*a*" in the rest position (dashed illustration) and the relative movement thereof to each other using the full lines. The rest position of the wave crest tails 3*a* is in each case illustrated by the dashed line, wherein the movement thereof, that is to say the lateral movement thereof in the transverse direction of the membrane 1 clamped in this case, has a corresponding curvature, as can clearly be seen. The axis lines of the wave trough tails 4*a* are likewise illustrated schematically. Thus, in the membrane system a whole array of undesired additional resonance frequencies act and can lead to additional movements of the flank sides and hence, in particular, also to a relative movement of the individual wave crest tails 3*a* or wave trough tails 4*a*; this is very disadvantageous. This results in nonlinearities in the frequency response and distortions of the original signal.

It is also possible that the wave crest tails 3*a* and wave trough tails 4*a* oscillate correspondingly unevenly in the vertical direction (this is not illustrated here), and so these oscillations also additionally load and/or distort the system as well, which in turn can lead to nonlinearities in the frequency response and distortions of the original signal.

SUMMARY OF THE INVENTION

It is accordingly an object of the invention to provide a membrane or a membrane configuration and/or an electrodynamic sound transducer such as a loudspeaker which overcome the above-mentioned disadvantages of the heretofore-known devices and methods of this general type and which provides for such a device that avoids undesired membrane oscillations. It is a particular object to at least significantly impede the above-noted adverse effects.

With the foregoing and other objects in view there is provided, in accordance with the invention, an air-motion-transformer (AMT) loudspeaker, comprising:

two pole plates disposed to define an air gap therebetween;

a substantially meander-shaped membrane disposed in the air gap, the membrane having a plurality of flank sides and a plurality of wave crests and wave troughs, extending in a longitudinal direction of the membrane;

conductor tracks extending along the plurality of flank sides;

mutually opposing the flank sides delimiting air pockets and respectively opposing individual the flank sides moving towards and away from one another in a transverse direction of the membrane during an operation of the loudspeaker;

each the wave crest and each the wave trough being defined with an axial center line and each carrying one or more strip-shaped stiffening elements, the stiffening elements being disposed on the axial center lines and extending evenly in the longitudinal direction;

the stiffening elements being formed and disposed to cause the flank sides to move towards and away from one another while remaining parallel to one another and to cause the axial center lines of the wave crests and the wave troughs to retain an axial orientation in the longitudinal direction of the membrane during the operation of the loudspeaker, and to prevent non-parallel oscillations of the flank sides relative to one another and bending of the flank sides during the operation of the loudspeaker.

In accordance with an added feature of the invention, the strip-shaped stiffening elements are strips disposed at a zenith of the wave crests and/or of the wave troughs. In a preferred embodiment, they extend an entire length of the membrane.

In accordance with an additional feature of the invention, the strip-shaped stiffening elements are aluminum strips.

With the above and other objects in view there is also provided, in accordance with the invention, an AMT loudspeaker, comprising:

two pole plates disposed to define an air gap therebetween;

a substantially meander-shaped membrane disposed in the air gap, the membrane having a plurality of flank sides and a plurality of wave crests and wave troughs, extending in a longitudinal direction of the membrane;

conductor tracks extending along the plurality of flank sides;

mutually opposing the flank sides delimiting air pockets and respectively opposing the flank sides moving towards and away from one another in a transverse direction of the membrane during an operation of the loudspeaker;

a frame formed with lateral frame parts laterally framing the membrane;

a stabilizing element disposed to stabilize an axial alignment in the longitudinal direction of the wave crests and the wave troughs during the operation of the loudspeaker;

the stabilizing element being configured as a strip-shaped support element for functionally effectively connecting mutually adjacent wave crests or mutually adjacent wave troughs, along a transverse direction of the membrane, and the lateral frame parts of the frame;

the support element being configured at least partially elastic and disposed to prevent a lateral non-parallel oscillation of the side flanks relative to one another and bending of the flank sides during the operation of the loudspeaker.

In accordance with another feature of the invention, the stabilizing element is configured and disposed to assure that individual the flank sides move precisely parallel toward or away from one another during an operation of the loudspeaker and the wave crests and the wave troughs, namely the axial alignment of the wave crest tails or the wave trough tails, substantially maintain a positional alignment thereof during the operation of the loudspeaker.

In accordance with a further feature of the invention, the support element is configured and disposed such that the wave crests and/or wave troughs, lying adjacent to one another in the transverse direction of the membrane, and the lateral frame parts are connected to each other in a functionally effective fashion.

In accordance with again an added feature of the invention, the support element is at least partially elastic and/or it may be formed of or with a web or fabric (e.g. screen, linen).

In accordance with a concomitant feature of the invention, the stiffening strips and/or the support element is glued to the membrane and/or to the frame by way of an adhesive and/or a plastic region forming a functionally effective connection.

In other words, the objects of the invention are achieved by the fact that additionally at least one stabilizing element is provided which stabilizes the position and/or the alignment of at least one wave crest and/or wave trough. As a result of provision now being made for a stabilizing element, namely preferably a stiffening element or a support element, preferably a plurality of stiffening elements or a plurality of support elements which stabilize the position and alignment of the wave crests and/or wave troughs (particularly during operation), the irregular oscillations of the membrane, in particular the undesired oscillations of the wave crest tails or wave trough tails, and hence the oscillations of the flank sides, can be avoided in the lateral and/or vertical direction. This eliminates nonlinearities in the frequency response and distortions of the original signals and so an electrodynamic sound transducer in which a membrane according to the invention is provided has decisive acoustic advantages and is decisively improved. The disadvantages listed initially are therefore avoided and corresponding advantages are achieved.

It will be understood that there exist a multiplicity of options for refining and further developing the membrane according to the invention in an advantageous fashion. Reference is had to the appended claims in which other features that are considered as characteristic for the invention are set forth.

Although the invention is illustrated and described herein as embodied in a membrane or a membrane configuration and/or an electrodynamic sound transducer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
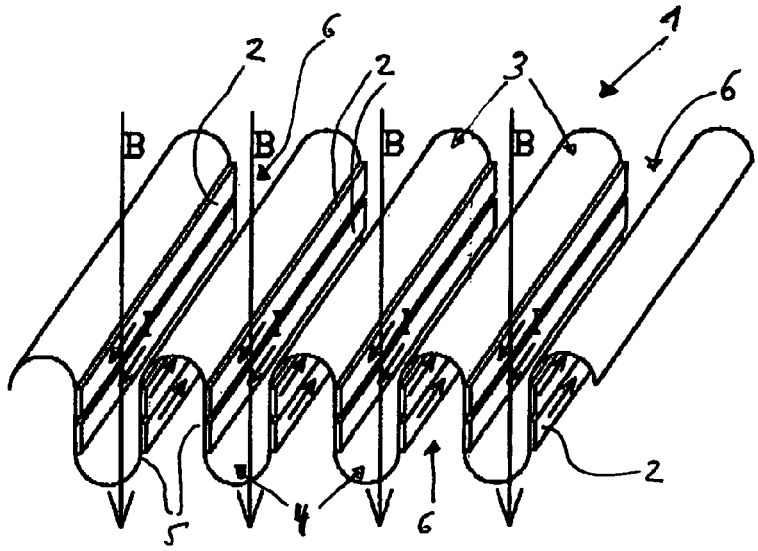
FIG. 1 PRIOR ART
FIG. 1 shows a schematic illustration of the design of a membrane known from the prior art.
Figure 2:
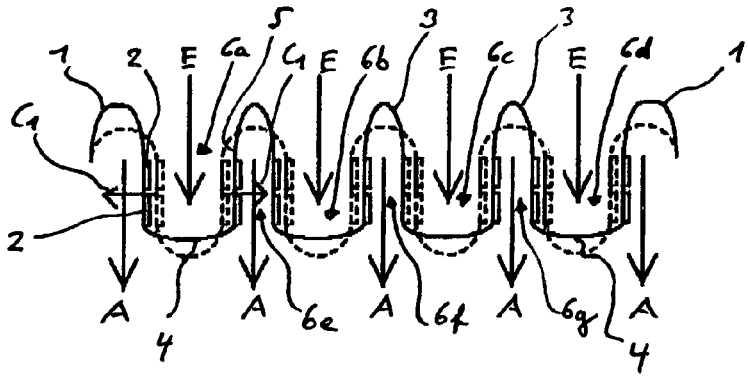
FIG. 2 PRIOR ART
FIG. 2 shows the membrane according to FIG. 1 in a schematic illustration from the side with the movements of the side flanks, respectively in a first direction.
Figure 3:
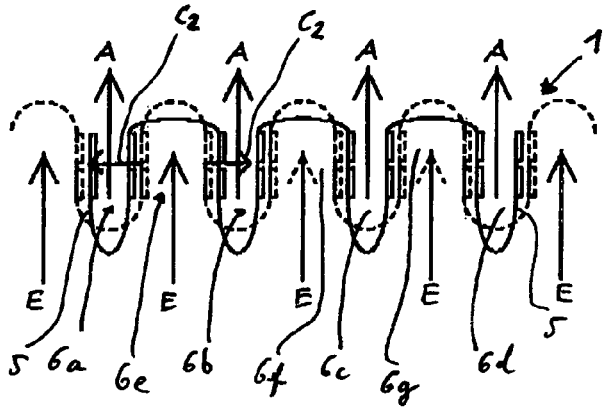
FIG. 3 PRIOR ART
FIG. 3 shows the membrane according to FIG. 1 in a schematic illustration with the movements of the side flanks, respectively in a second (opposing) direction.
Figure 4B:
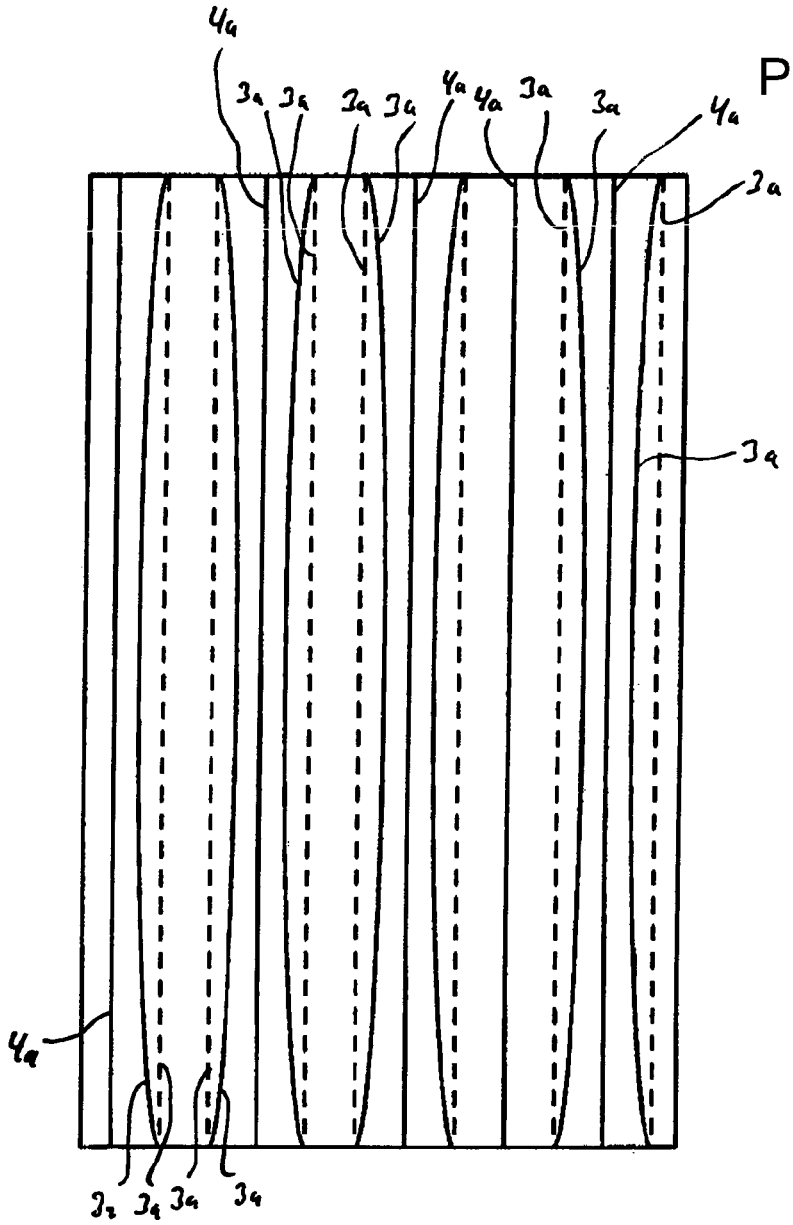
FIG. 4B PRIOR ART
FIGS. 4*a* and 4*b* show schematic illustrations of the undesired oscillations of a membrane and the deflection of the flank sides or the wave crest tails of a membrane during operation.
Figure 4A:
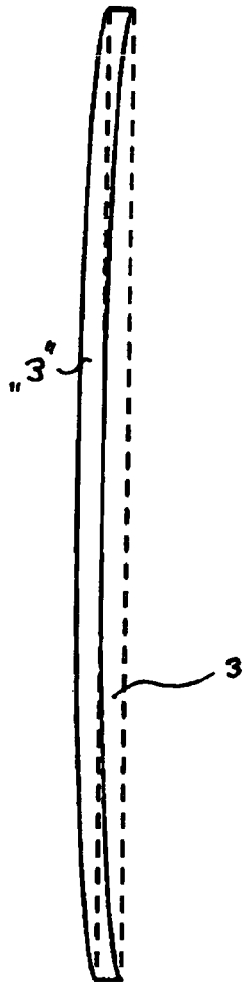
FIG. 4A PRIOR ART

Referring now once more to the figures of the drawing in detail FIGS. 5 to 20 show (at least in part) a membrane 1 according to the invention or a membrane configuration according to the invention for an electrodynamic sound transducer. The latter is not illustrated here in any more detail.

Figure 18:
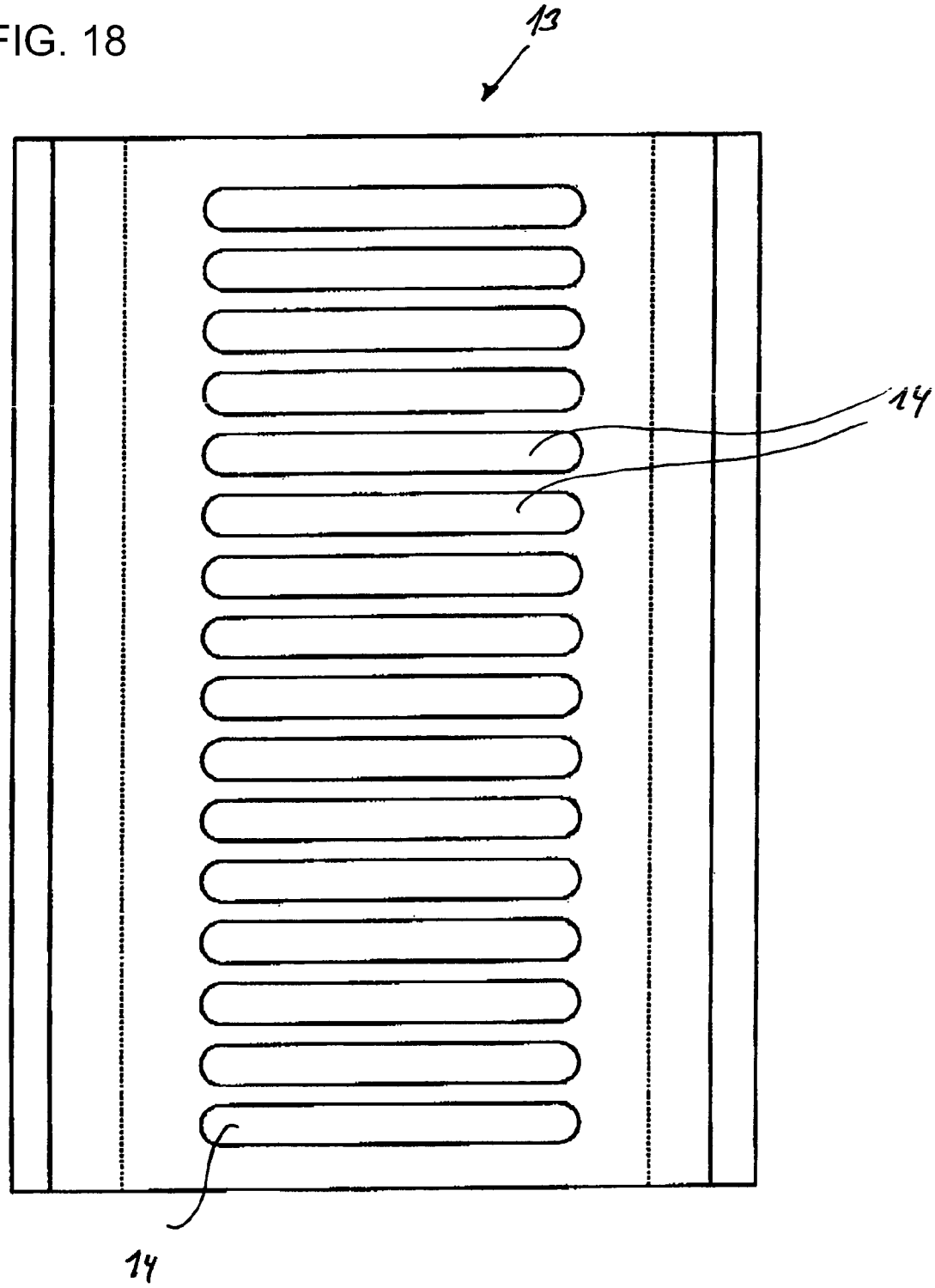
FIG. 18 shows a schematic illustration of a loudspeaker from the side with the recesses which can be seen in this case and with the membrane which is arranged therebehind and has in this case not been illustrated in a recognizable fashion.

The membrane 1 is preferably designed as a loudspeaker membrane and is provided in a loudspeaker, preferably in an ATM loudspeaker illustrated schematically in FIG. 18. Depending on the application, arranging such a membrane 1 in a microphone or in a headset or the like is also feasible.

In the installed state, in particular when arranged in an appropriate device, the membrane 1 is of a substantially meandering design, as can be seen in particular from the schematic design in FIGS. 5 to 9, 11, 13 and 15 to 17. In the case where the membrane 1 is designed as a loudspeaker membrane, it is preferably arranged between two pole plates 7 and 8 in an air gap 9 provided between the two pole plates 7 and 8, as is shown in a clear fashion, particularly in FIGS. 8, 9, 11 and 15 to 17, 19 and 20.

FIGS. 5 to 17 (in part) clearly show that the membrane 1 has a plurality of mutually opposing flank sides 5 and a plurality of wave crests 3 and wave troughs 4. Basically, a wave trough 4 is between two adjacent wave crests 3 and a wave crest 3 is between two adjacent wave troughs 4 and so the corresponding "accordion shape" is created, as illustrated in the figures.

Furthermore, respectively two conductor tracks 2 through which alternating current preferably flows are preferably provided on the flank sides 5. One or three conductor tracks are also feasible. The flank sides 5 of the membrane 1 then move toward or away from one another in substantially the transverse direction (X-direction) as a function of the respective direction of the current or the actuation and alignment of the applied "permanent magnetic field", preferably of the electrostatic magnetic field. This means that two opposing flank sides 5 respectively delimiting an air pocket 6 either move toward or away from one another in the corresponding transverse direction (X-direction) such that the air pockets 6 either suction in or push out air, in which the wave crests 3 and wave troughs 4 are basically arranged on or run along the axial direction (Y-direction; longitudinal direction), as illustrated.

The disadvantages mentioned initially are now avoided by the fact that additionally at least one stabilizing element 10 is provided which stabilizes the position and/or the alignment of at least one wave crest 3 and/or wave trough 4. The stabilizing element (10) or preferably the stabilizing elements (10) can now have differing designs. The stabilizing element (10) is preferably designed as a strip-shaped stiffening element (10*a*) or as a support element (10*b* or 10*c*, 10*d*, 10*e*, 10*f*), which will be explained in due course in the following text. As a result of arranging or forming a corresponding element 10 preferably directly on the membrane 1 or within a certain membrane configuration, which will be described in more detail in the following text, the bothersome curves/oscillations of the flank sides 5 and the wave crests 3 and wave troughs 4 explained initially are now avoided during operation. Thus, the flank sides 5 oscillate regularly and so the individual flank sides 5 basically always move precisely parallel toward or away from one another and the wave crests 3 and the wave troughs 4 in particular, namely the axial and/or vertical alignment of the wave crest tails 3*a* or the wave trough tails 4*a* in particular, substantially maintain the position and/or alignment thereof, even during operation of the membrane 1 and hence the entire oscillating system is stabilized. Thus, the disadvantages mentioned initially are avoided and corresponding advantages are obtained.

There now are different options for designing and developing the corresponding stabilizing element 10, or correspondingly arranging the latter on a membrane 1 or for designing a corresponding membrane configuration such that the abovementioned objects are achieved. Hence the corresponding embodiments may now be explained in more detail in the following text on the basis of the drawing.

Figure 5A:
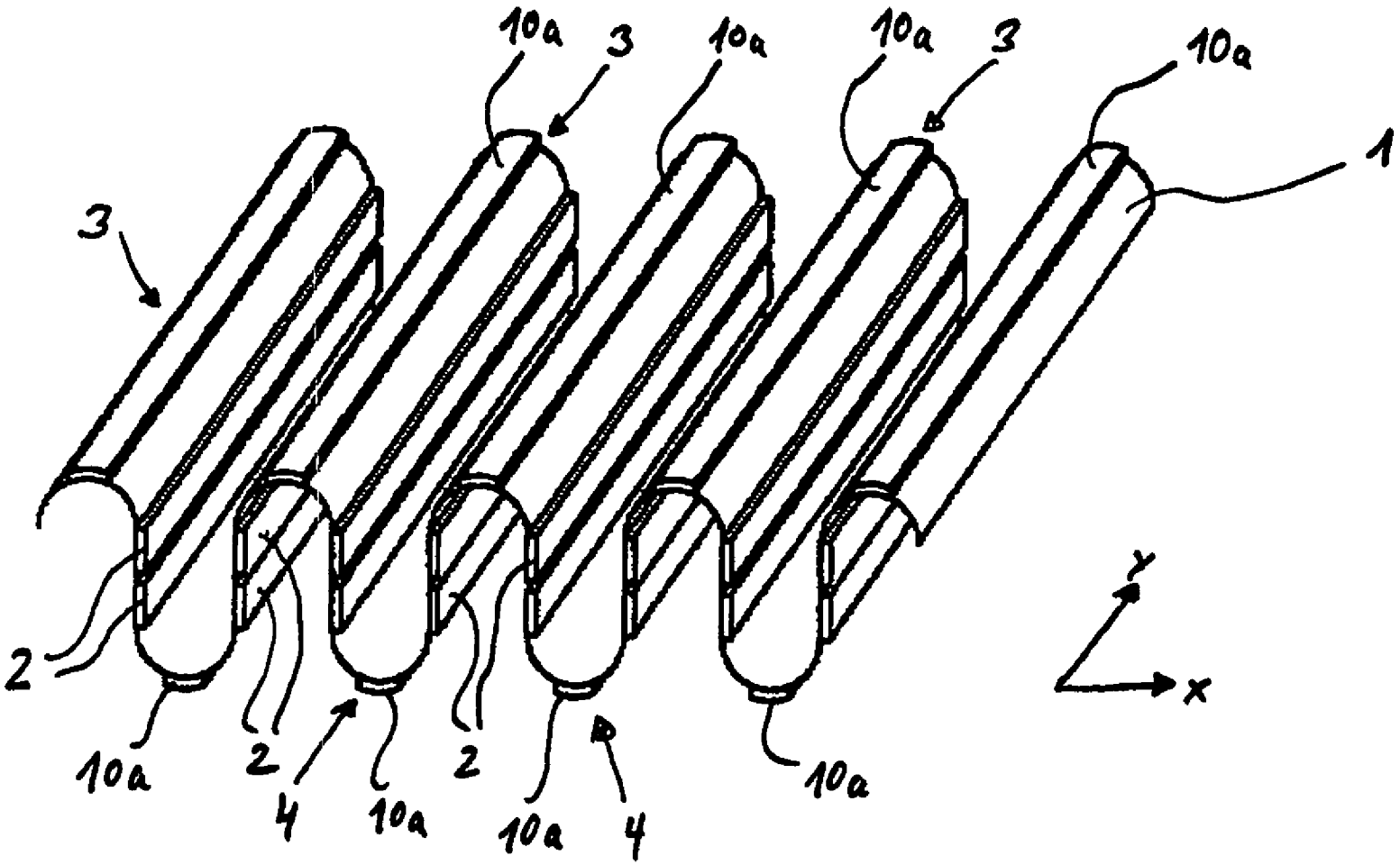
FIGS. 5*a* and 5*b* show first, slightly differing embodiments of a membrane according to the invention in a schematic perspective illustration.

Like the other illustrations, FIG. 5*a* shows a schematic illustration of the membrane 1 as a simple full line with the conductor tracks 2 arranged thereon. Here, each wave crest 3 and each wave trough 4 is preferably in each case provided with a corresponding stiffening element 10*a* as a stabilizing element 10 which is of a strip-shaped design (and which could by all means also be referred to as a "support element"). In the axial direction, the strip-shaped stiffening elements 10*a* are preferably arranged in the region of the wave crest tail 3*a* or in the region of the wave trough tail 4*a*, as illustrated. The strip-shaped stiffening elements 10*a* are preferably produced from aluminum. The stiffening elements 10*a* are therefore preferably arranged on the respective axis axes of the wave crests 3 or the wave troughs 4 particularly in a precisely regular fashion on the respective wave crest tail 3*a* or the respective wave trough tail 4*a*. Thus the corresponding position and/or alignment of the wave crests 3 and wave troughs 4 are appropriately stabilized. A lateral non-parallel oscillation of the side flanks 5 with respect to one another is therefore avoided because the position and/or alignment of the wave crests 3 and wave troughs 4 are stabilized.

As mentioned previously, the strip-shaped stiffening elements 10*a* are preferably designed as aluminum strips, with preferably each wave crest 3 and each wave trough 4 having a corresponding stiffening element 10*a*. The strip-shaped stiffening elements 10*a* can preferably also be produced in a similar fashion to the conductor tracks 2 and preferably be formed on a membrane 1 in an appropriate arrangement by means of corresponding etching methods such that in this case the initially planar membrane only has to be correspondingly folded for operation 1, as illustrated in FIG. 5*a*.

The stiffening elements 10*a* which are preferably designed as aluminum strips have a higher Young's modulus than the material of the membrane 1 itself, that is to say the stiffening elements 10*a* are thus stiffer than the material of the membrane 1 and so arranging these stiffening elements 10*a* on the respective wave crest tail 3*a* or wave trough tail 4*a* correspondingly stiffens/strengthens this region of the membrane 1 and effects the abovementioned advantages.

Figure 5B:
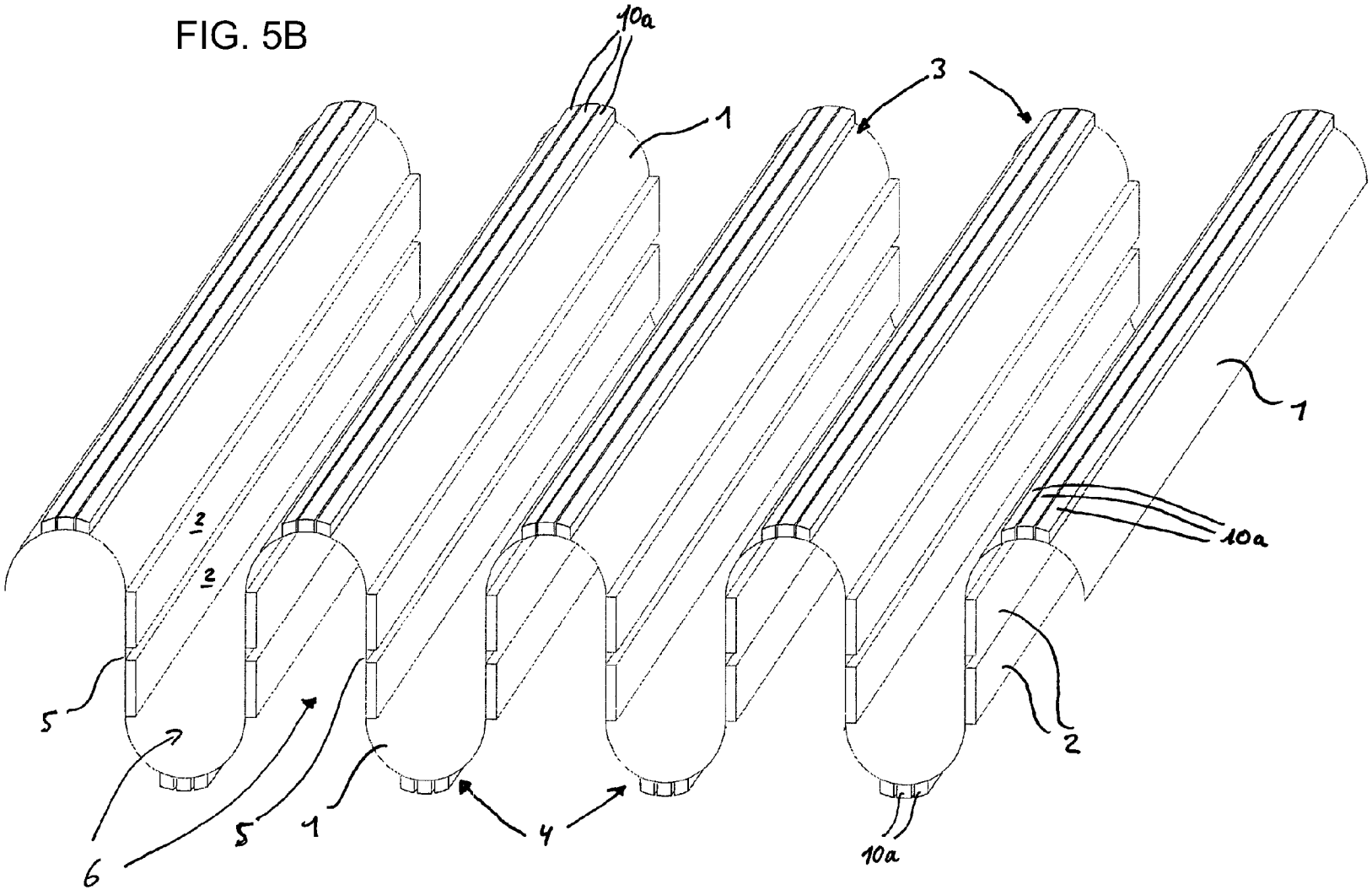

FIG. 5*b* now shows a further embodiment which differs slightly from the embodiment illustrated in FIG. 5*a*. Again, the following can clearly be seen: the membrane 1 only illustrated in the form of a line; the respective air pockets 6; the conductor tracks 2; and the wave crests 3 and wave troughs 4, or wave crest tails 3*a* and wave trough tails 4*a*. In this case too, similarly to the embodiment of FIG. 5, stiffening elements 10*a* are provided as stabilizing elements 10, but a number of stiffening elements 10*a* running in the axial direction are arranged parallel to one another in the region of the wave crests 3 or wave troughs 4; here three stiffening elements 10*a* are preferably provided in each case in the region of a wave crest 3 or wave trough 4, in particular on a wave crest tail 3*a* or a wave trough tail 4*a*, as illustrated in FIG. 5*b*. The respective stiffening elements 10*a* in turn are preferably designed in a strip-shaped fashion and run parallel to one another, but are designed as separate elements from one another. Compared to the arrangement shown in FIG. 5*a*, the advantage of this arrangement is that the mobility of the membrane 1 in the arc region, that is to say in the region of the respective wave crest 3 or the respective wave trough 4, is substantially maintained but at the same time this region is stabilized. It is also feasible for there to be only two stiffening elements 10*a*, arranged parallel to one another on a respective wave crest 3 or wave trough 4, or else, for example, for there to be four stiffening elements 10*a* arranged parallel to one another; this depends on the respective application, on the size, dimension and design of the respective membrane 1 and the wave crests and/or troughs 3 and 4, as well as the width of the respective stiffening elements 10*a*.

Figure 6:
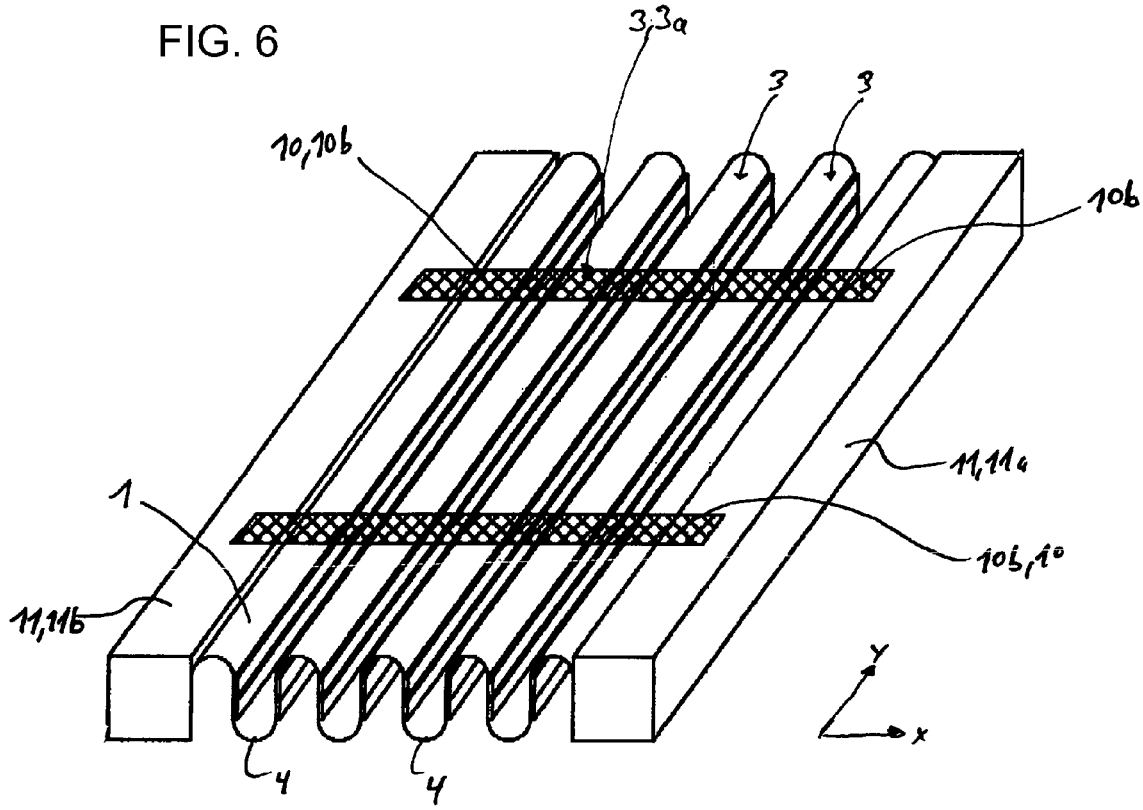
FIG. 6 shows a second embodiment of a membrane configuration or design according to the invention in a schematic perspective illustration.
Figure 7:
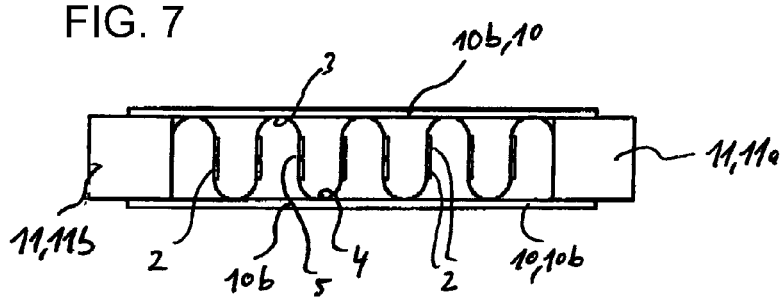
FIG. 7 shows the membrane illustrated in FIG. 6 in a schematic illustration from the side.

FIGS. 6 and 7 now show different embodiments of a stabilizing element 10, namely support elements 10*b*. Here it can clearly be seen that the membrane 1 is arranged in a type of frame 11, wherein only two lateral elements 11*a* and 11*b* of the frame 11 are shown in this case or, also, wherein only these two lateral elements 11*a*/11*b* have to be provided, depending on the application. Now, the support elements 10*b* are designed and/or arranged in this case such that the adjacent wave crests 3 or wave troughs 4 lying in the transverse direction of the membrane 1 and the lateral frame parts 11*a* and 11*b* are connected to each other in an effective fashion. FIG. 6 shows that two support elements 10*b* of preferably strip-shaped design are arranged (basically in the x-direction)

on the top side of this arrangement and, as is shown in FIG. 7, preferably two support elements 10*b* are likewise arranged on the lower side.

The support elements 10*b* which can be seen here in FIGS. 6 and 7 are preferably partially of an elastic design, in particular so as also to be able to join in in the slight vertical up and down movements of the wave crests 3 or wave troughs 4. The support elements 10*b* are preferably designed as elastic grid elements and have a web-like structure; they are produced in particular from fly-screen or linen. The support elements 10*b* are preferably adhesively bonded to the corresponding places of the frame parts 11*a* and 11*b* and to the corresponding regions of the wave crests 3 and wave troughs 4. As a result of the corresponding wave crests 3 or wave troughs 4 (at the top or bottom of the arrangement illustrated in FIGS. 6 and 7, depending on the point of view) now being connected laterally to the frame part 11*a* and 11*b*, the position and/or alignment of the individual wave crests 3 or wave troughs 4, in particular the wave crest tails 3*a* or wave trough tails 4*a*, is correspondingly stabilized, which in turn effects the above-mentioned advantages.

Figure 8:
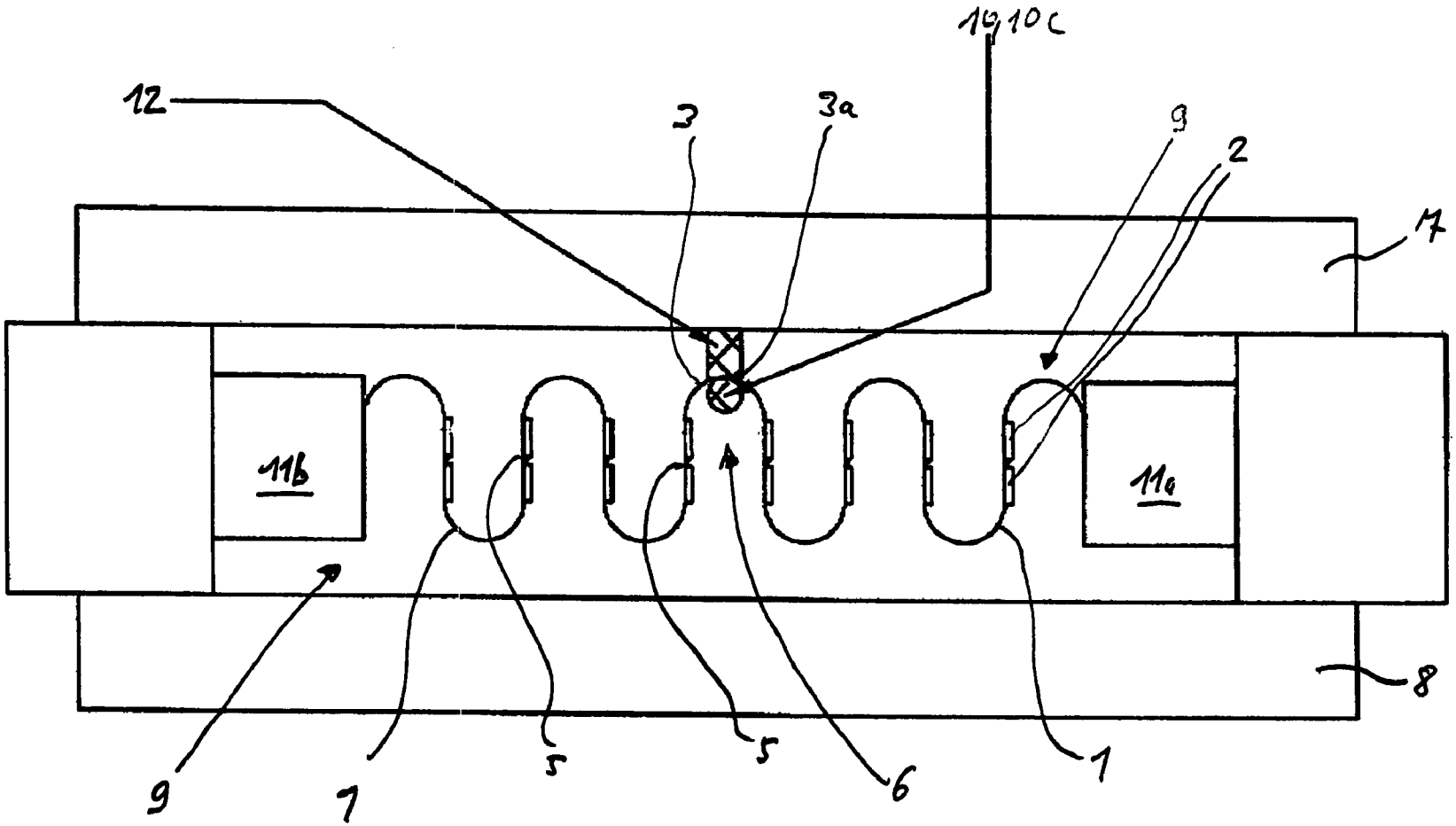
FIG. 8 shows a schematic illustration of a third exemplary embodiment of a membrane configuration according to the invention in a schematic illustration from the side.

FIG. 8 now shows a membrane 1 or a membrane configuration, wherein the membrane 1 is in this case correspondingly arranged in an air gap 9 provided between two pole plates 7 and 8. The frame 11 for the membrane or the lateral frame parts 11*a* and 11*b* are also illustrated in a clearly visible fashion.

Figure 9:
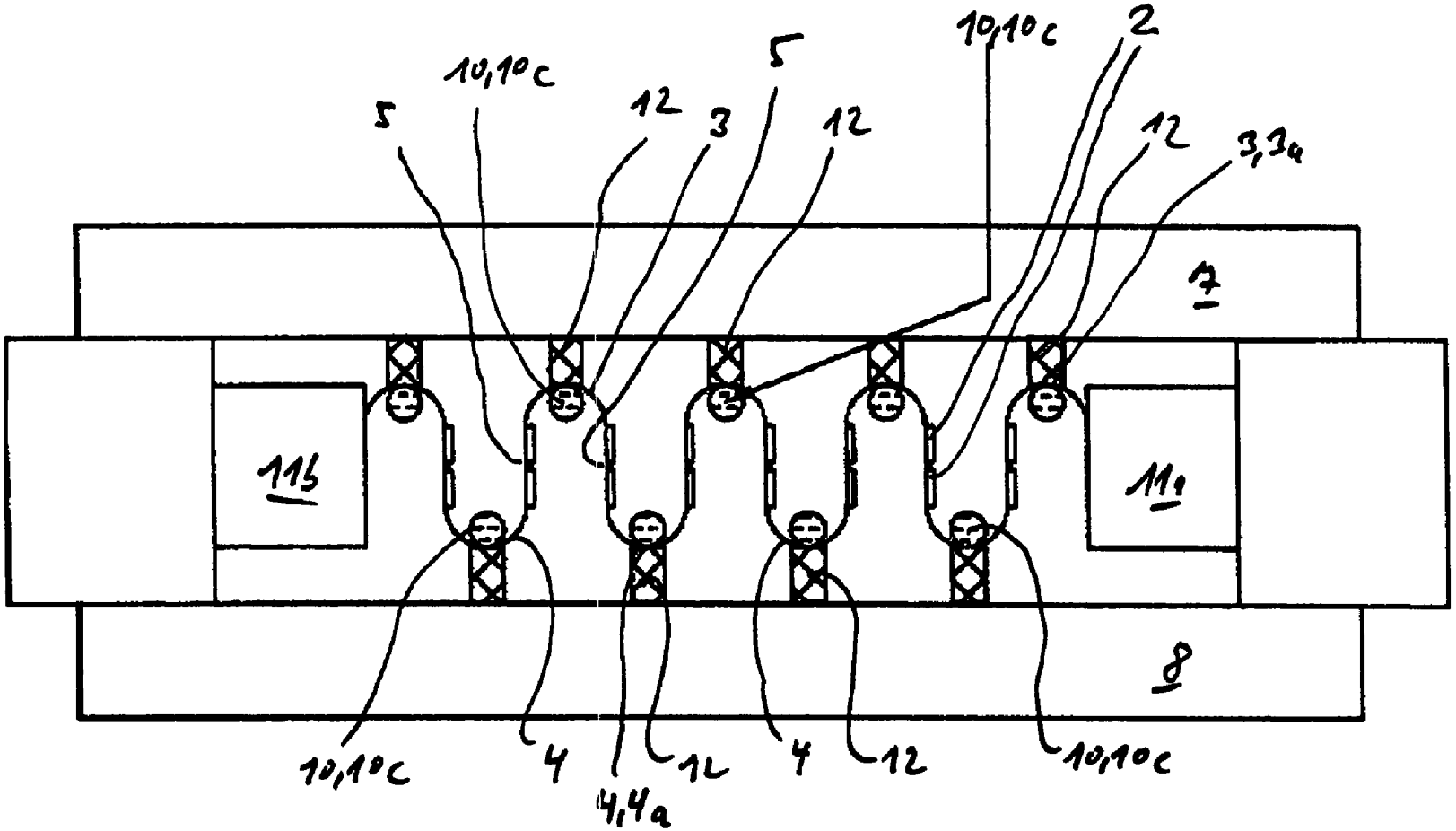
FIG. 9 shows a schematic illustration of a fourth exemplary embodiment of a membrane configuration according to the invention, similar to the one from FIG. 8.
Figure 10:
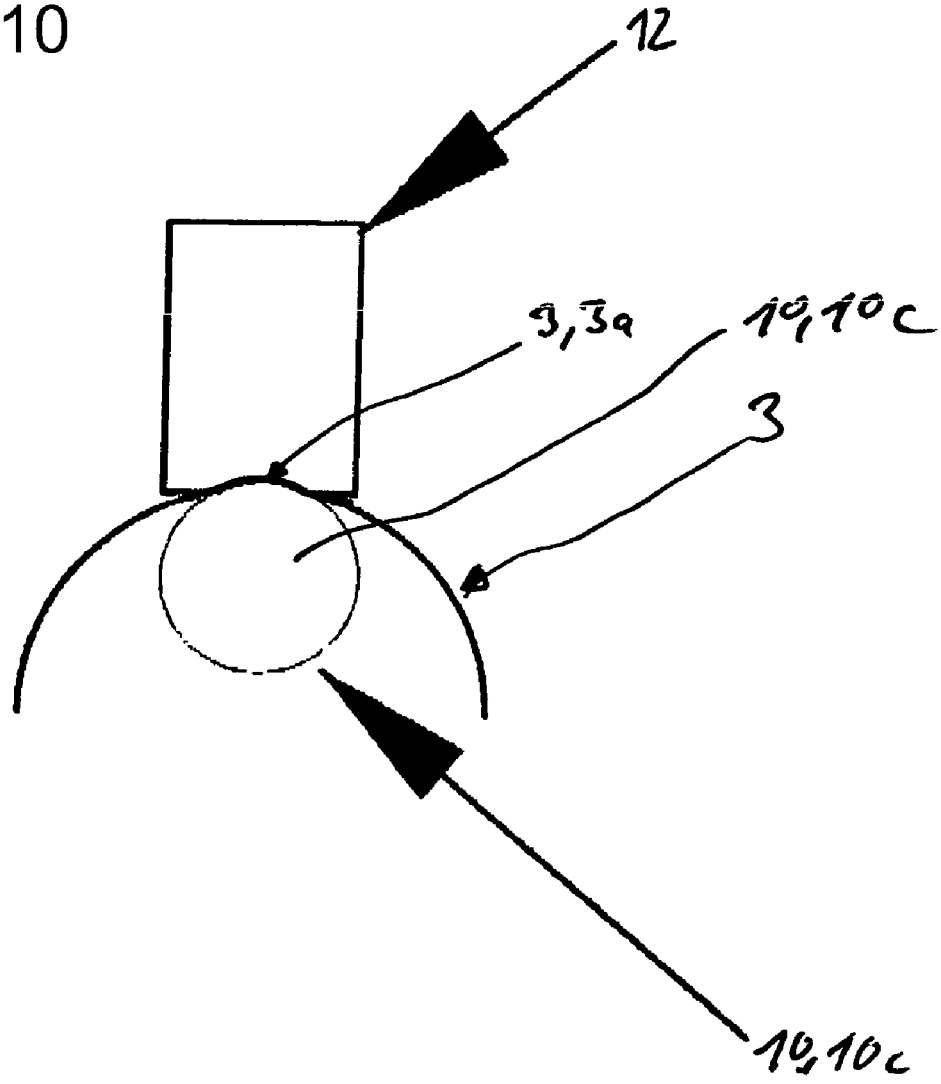
FIG. 10 shows an enlarged schematic illustration of a section from FIG. 8 or from FIG. 9, namely a corresponding stabilizing support element in an enlarged schematic illustration.

FIGS. 8, 9 and 10 now show an exemplary embodiment of a support element 10, namely a support element 10*c* of a rod-shaped design and basically running along the inner lower region of an air pocket 6, which in this case runs in the axial direction in the inner region of a wave crest 3 in FIG. 8, or which is adhesively bonded to or arranged on the membrane 1 in this case. The support element 10*c* is rod-shaped and preferably produced from a metal, preferably iron.

Then, a web element 12 lying opposite to the support element 10*c* is arranged on the opposite side of the membrane 1 and in this case has a substantially rectangular cross section, as illustrated in FIGS. 8 to 10. As shown in FIG. 8, the web element 12 is arranged on a pole plate 7. During operation, that is to say particularly when a magnetic field, in particular an electrostatic magnetic field as illustrated by arrows B in FIG. 1, is applied, the rod-shaped support element 10*c* is then pushed against the web element 12 due to magnetic action, and so the membrane 1 is correspondingly fixed, in particular the wave crest tail 3*a* in this case in FIG. 8, that is to say the position and alignment of the wave crest tail 3*a* is stabilized. To this end the web element 12 preferably also has a corresponding groove such that a lateral hold of the support elements 10*c* is ensured in the case of the appropriate contact, as illustrated schematically in FIG. 10.

As FIG. 9 now shows, corresponding support elements 10*c* are preferably provided for each wave crest 3 and for each wave trough 4. Correspondingly, appropriate web elements 12 are provided for this purpose on the respective pole plates 7 and 8 and so—in end effect—in the arrangement illustrated in FIG. 9 each wave crest 3 and each wave trough 4, or each wave crest tail 3*a* and each wave trough tail 4*a*, is correspondingly aligned or fixed during operation.

It is also feasible that the support elements 10*c* are partly designed in a rod-shaped fashion, that is to say they do not necessarily have to extend over the entire axial length (Y-direction, longitudinal direction) of the membrane 1, but only over corresponding partial regions; this depends on the respective application. It is also feasible for the support elements 10*c* to have other cross-sectional shapes, that is to say not only round cross-sectional shapes but preferably cross-sectional shapes which do not impede the movement of the side flanks 5.

The web elements 12 are preferably produced from a thermally conducting material which influences the properties of the membrane 1 in a positive fashion and which can also exert a magnetic action (alignment) on the support elements 10*c*.

Figure 11:
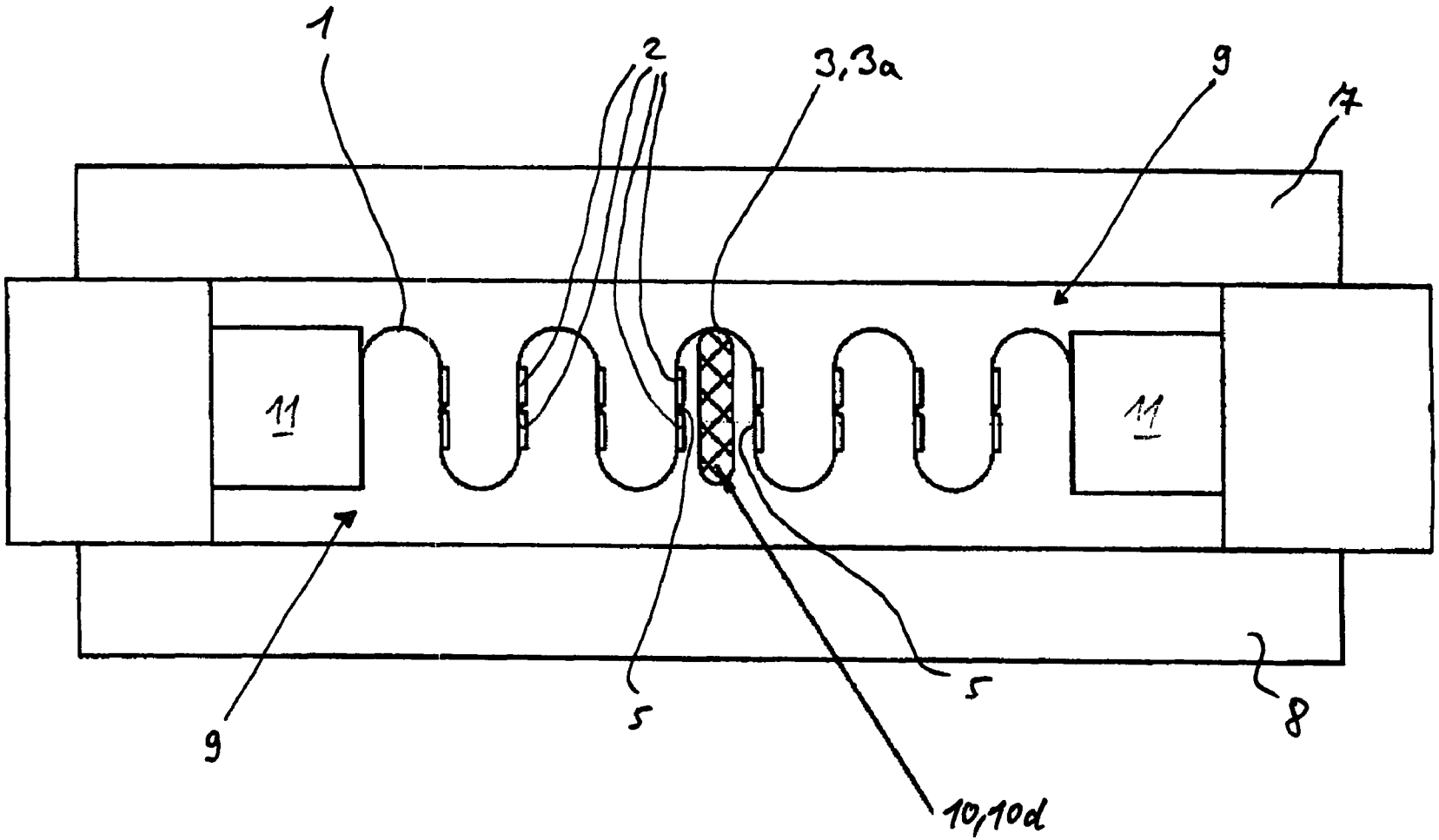
FIG. 11 shows a schematic illustration of a fifth exemplary embodiment of a membrane configuration according to the invention from the side.
Figure 12:
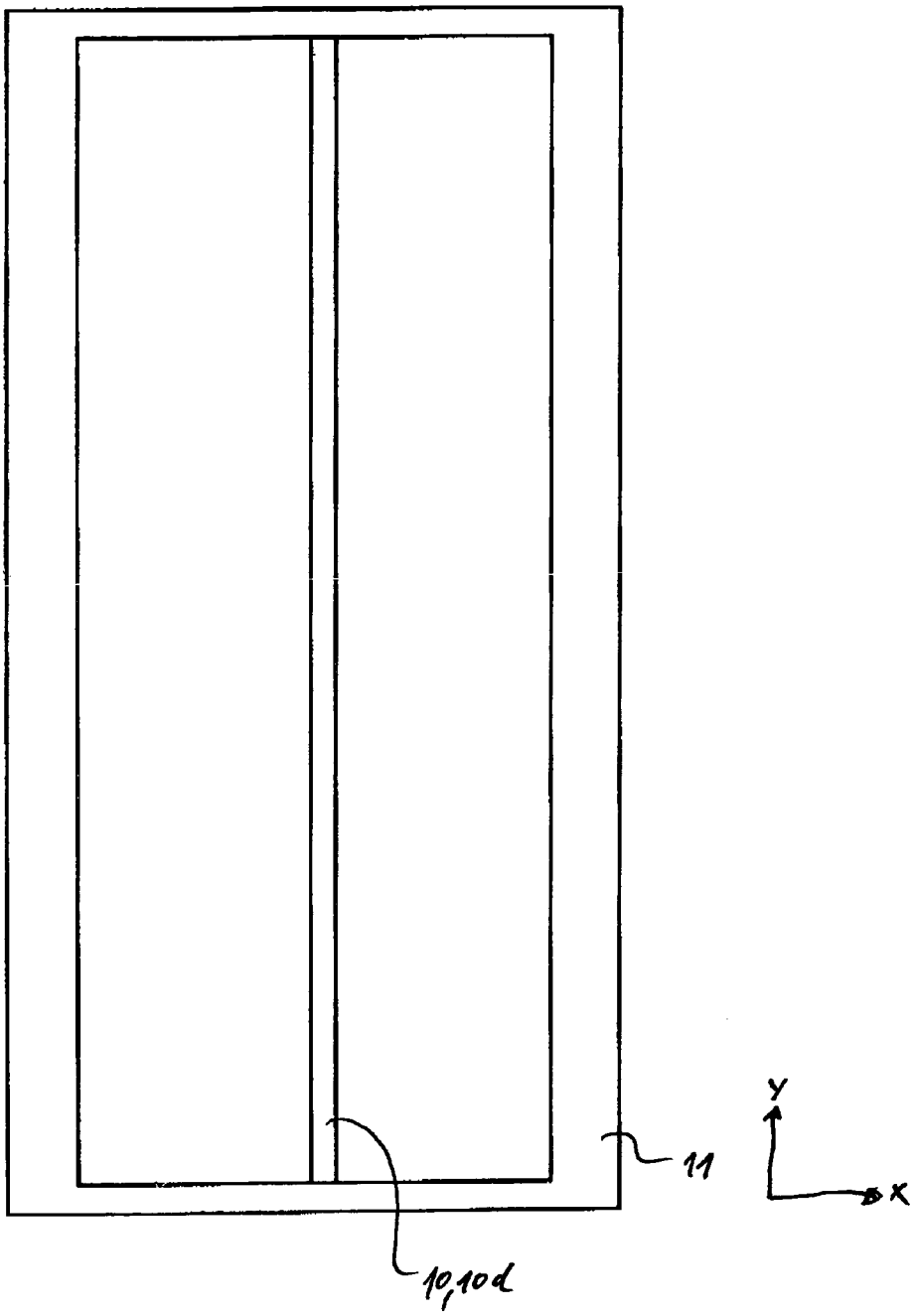
FIG. 12 shows a schematic illustration onto a frame for the membrane configuration according to the invention from FIG. 11 from above.

FIGS. 11 and 12 now show a membrane 1 or a membrane configuration, wherein the membrane 1 is arranged in an air gap 9, between two pole plates 7 and 8. FIG. 12 shows a corresponding frame 11 in a schematic plan view. The support element 10*d*, which is preferably designed as a support profile in this case, can clearly be seen in this case. In other words, the support element 10*d* is designed as part of the frame 11 and, as illustrated in FIG. 11, acts on the membrane 1 such that in the illustration of FIG. 11 the alignment of the wave crest 3, namely the wave crest tail 3*a*, is well positioned or fixed. Therefore, when the membrane 1 is clamped in the frame 11 and provision is made for the support element 10*d* running in the axial direction (Y-direction), the membrane 1 can be arranged such that the support element 10*d* designed as a support profile is provided in the region between two flank sides 5 and at least a portion contacts the respective wave crest 3 for the purposes of stabilizing the latter, as illustrated in FIG. 11.

Figure 13:
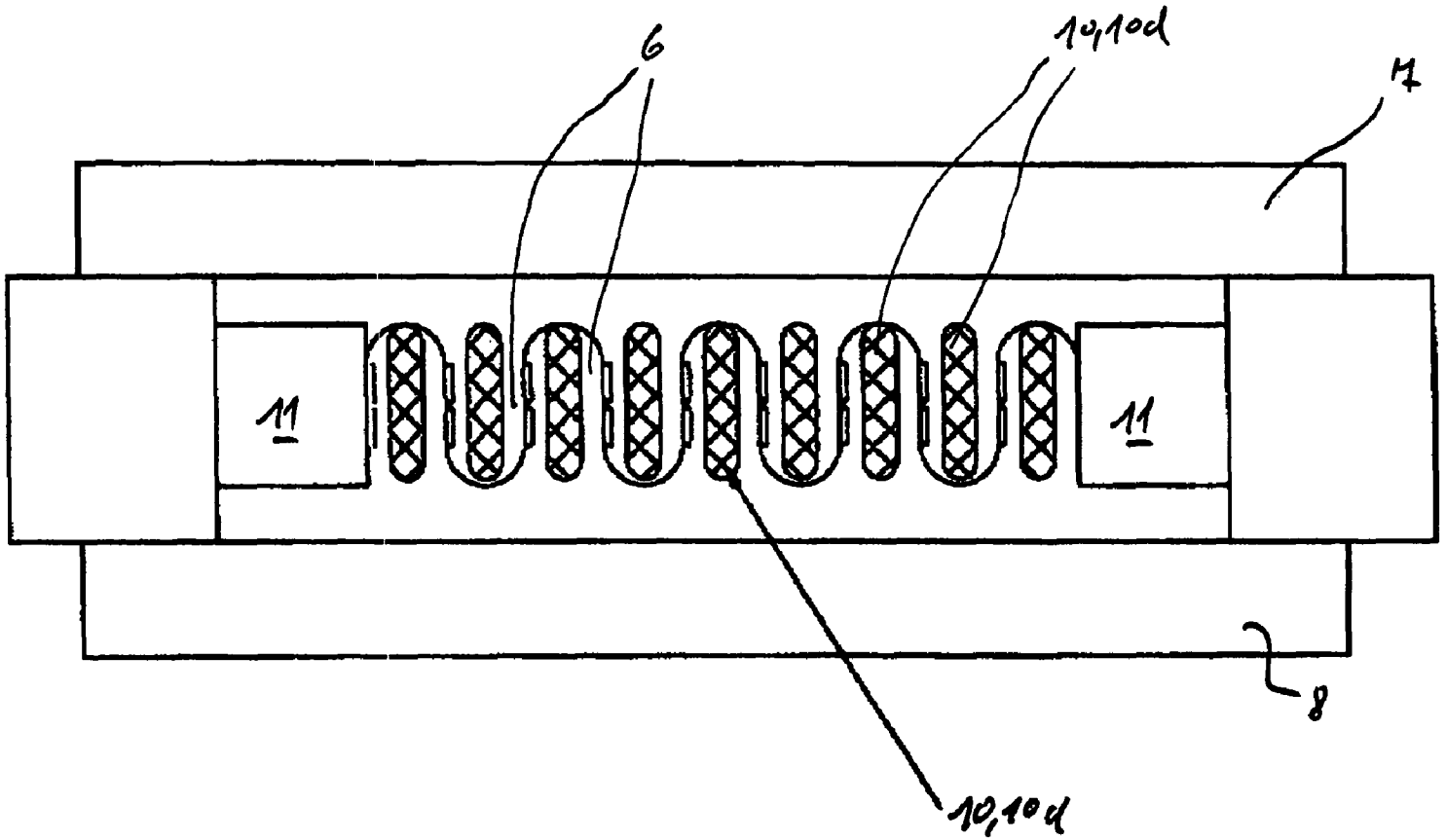
FIG. 13 shows a schematic illustration of a sixth exemplary embodiment of a membrane configuration according to the invention from the side.
Figure 14:
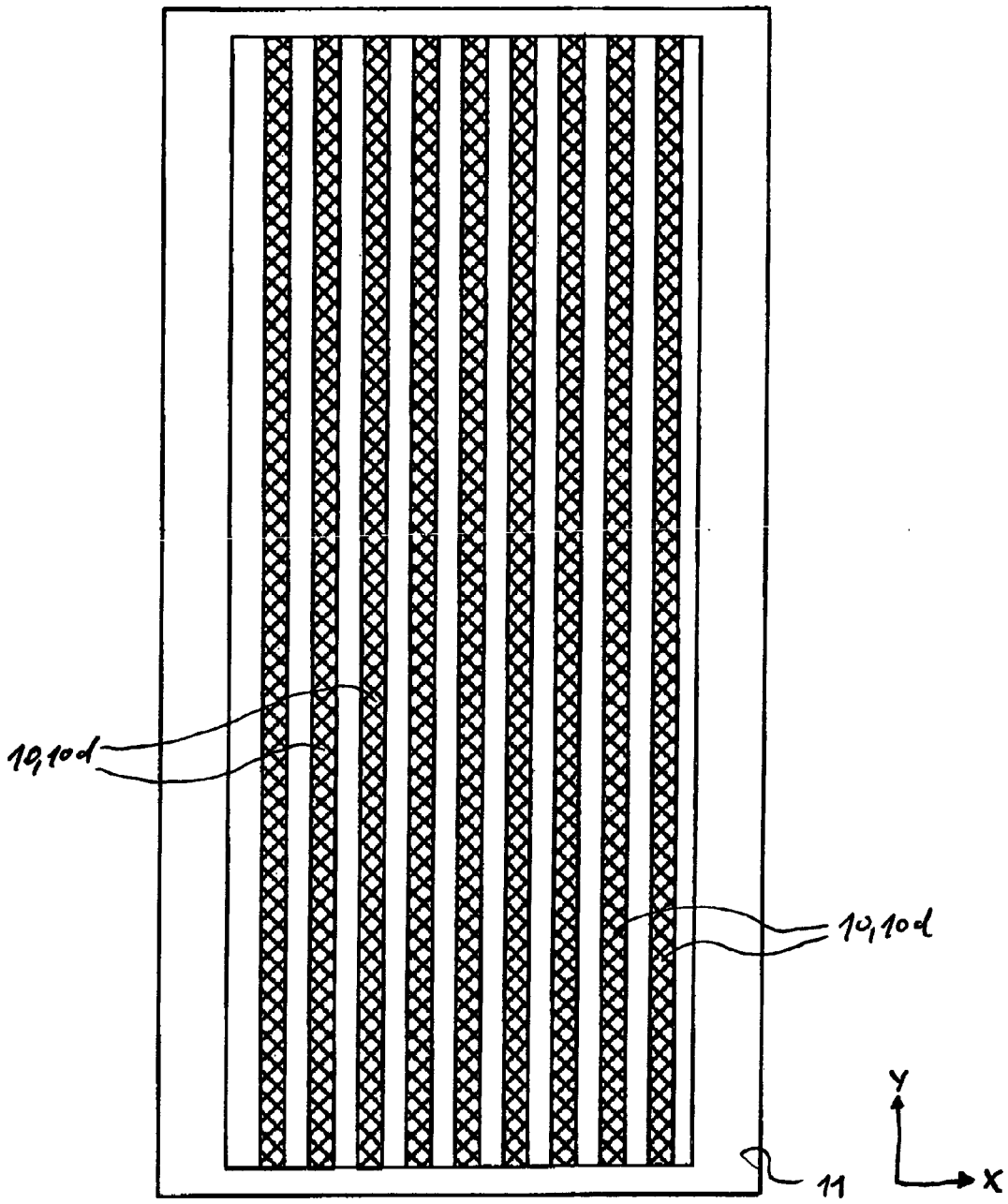
FIG. 14 shows a schematic illustration onto a frame for the membrane configuration according to the invention from FIG. 13 from above.

In that case provision is preferably made for a number of support elements 10*d* designed as support profiles, as illustrated in FIGS. 13 and 14. In other words, the frame 11 preferably has a number of support elements 10*d* running along the axial direction (Y-direction) which are used to stabilize the membrane 1 of meandering design and are designed such that within the air pockets 6 they can be accordingly arranged within the region of the wave crests 3 and wave troughs 4 for the purposes of fixing, positioning/aligning the wave crests and wave troughs and can come to rest here in each case on the inner surfaces, preferably under pre-tensioning, and/or come to rest after a certain movement of the membrane 1.

Figure 15:
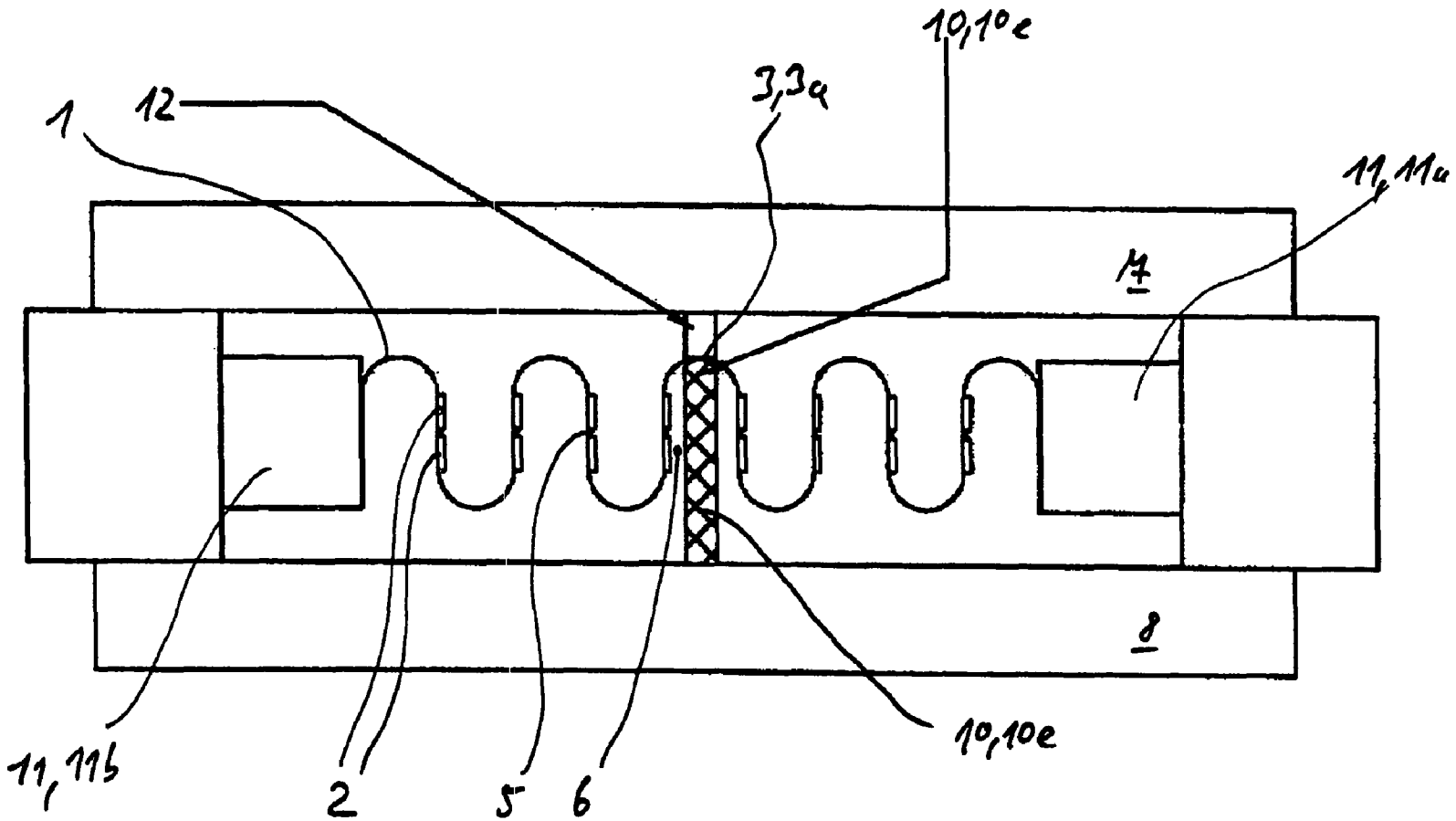
FIG. 15 shows a seventh exemplary embodiment of a membrane configuration according to the invention.
Figure 16:
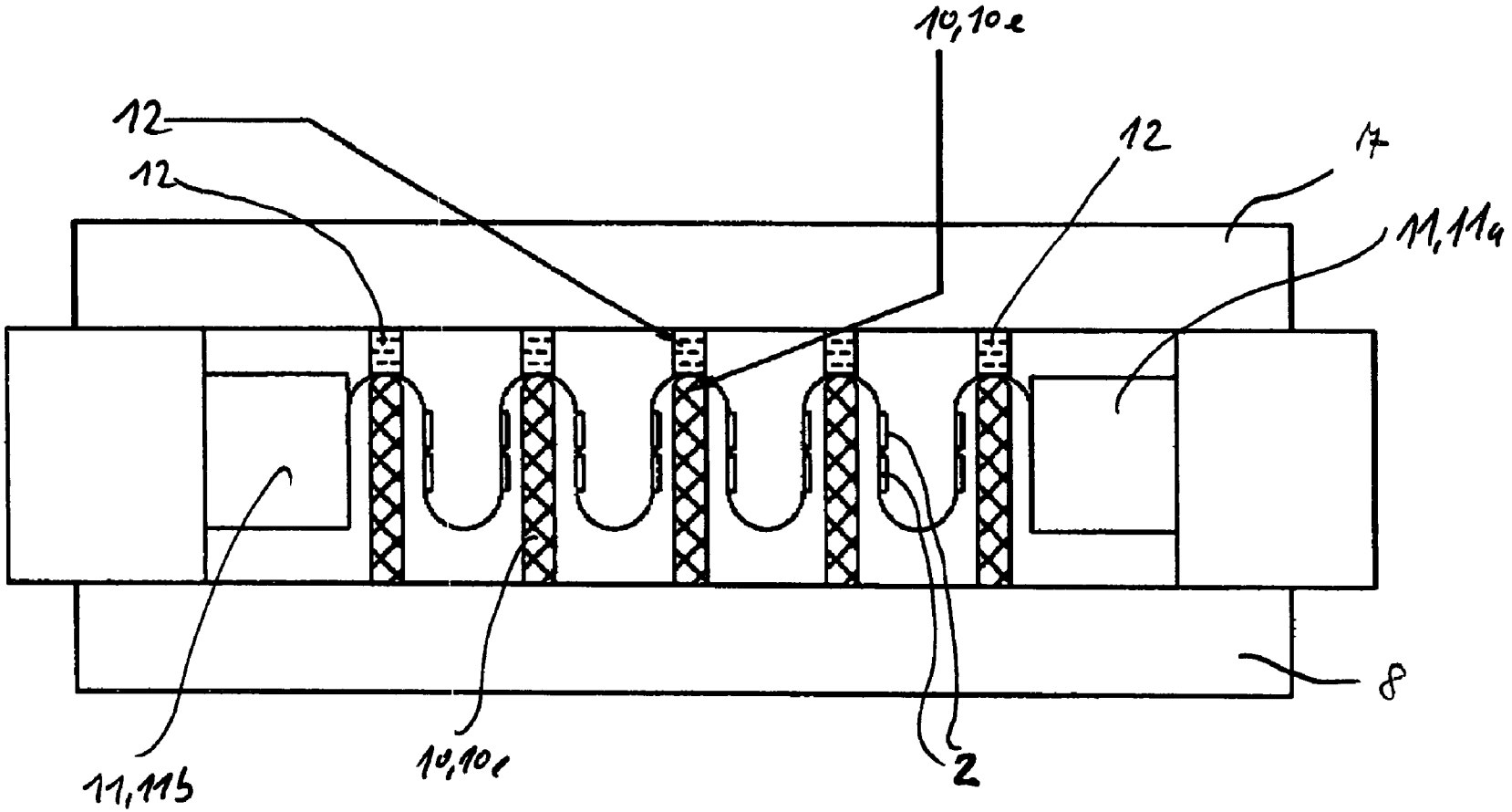
FIG. 16 shows a schematic illustration of an eighth exemplary embodiment of a membrane configuration according to the invention.
Figure 17:
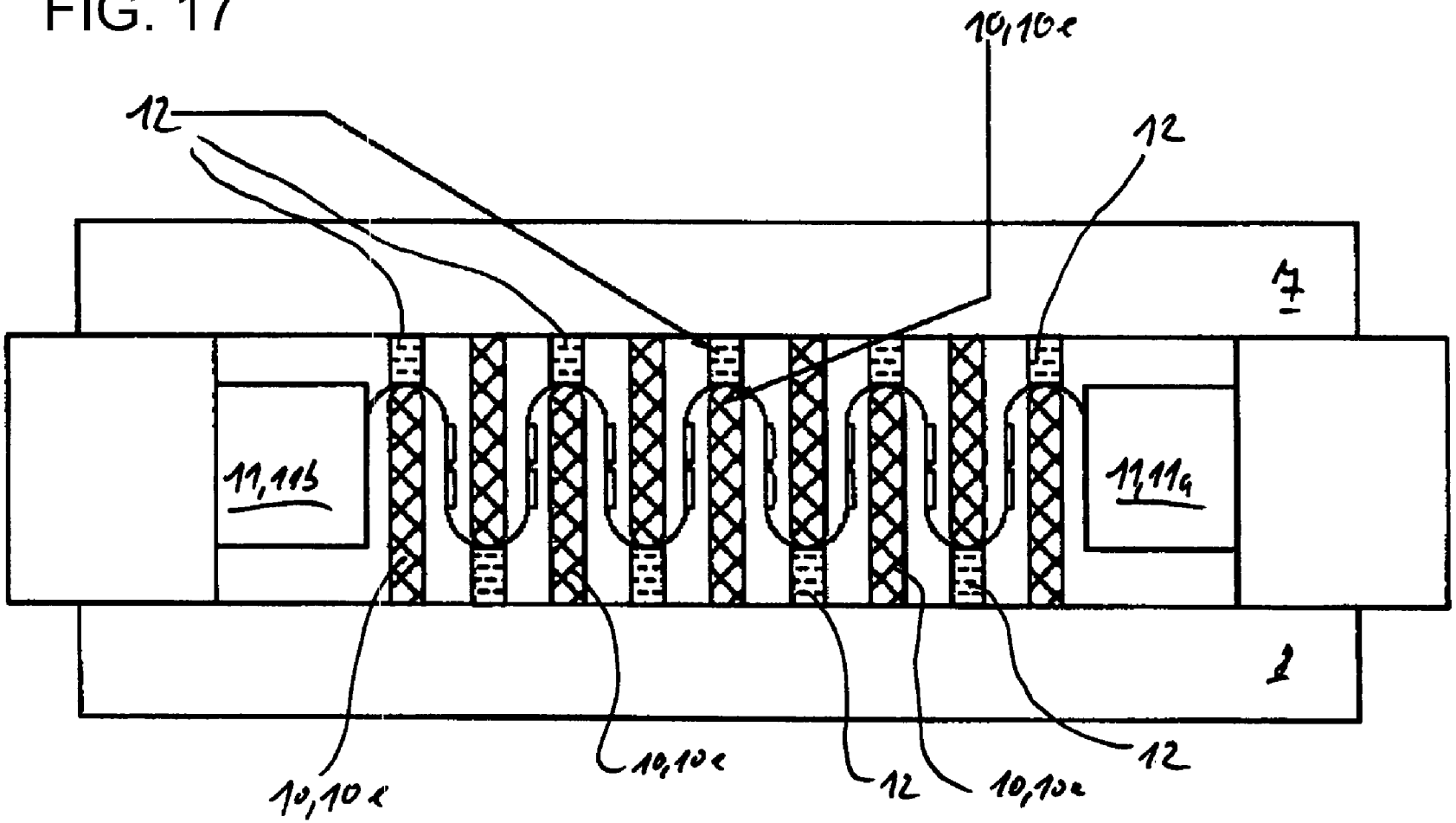
FIG. 17 shows a schematic illustration of a ninth exemplary embodiment of a membrane configuration according to the invention.

FIGS. 15 to 17 show a further embodiment of a support element 10 or a corresponding membrane configuration between two pole plates 7 and 8. As in the previous examples, the corresponding membrane 1 is preferably arranged within a frame 11 or within frame parts 11*a* and 11*b*. Provision is once again made in this case for a web element 12, as illustrated in FIG. 15. The support element 10*e* provided for the membrane 1, in particular for the wave crest 3 in this case, now preferably is of a "strut-shaped" design, which means that it basically extends over the entire air pocket 6 to the other pole plate 8 and is attached thereto. In FIG. 15, the wave crest 3 or the wave crest tail 3*a* is then once again correspondingly fixed or aligned in this case by the strut-shaped support element 10*e* and the web element 12 lying on the opposite side of the membrane 1.

FIGS. 16 and 17 show that in this case provision can be made for a number of web elements 12 as well as a number of strut-shaped support elements 10*e*. This depends on the respective application and the fashion of the necessity of the number of support elements 10 to be provided.

Finally, FIG. 18 shows a schematic illustration of a loudspeaker 13 from the front with output openings 14 behind which the corresponding membrane 1 is arranged.

Figure 19:
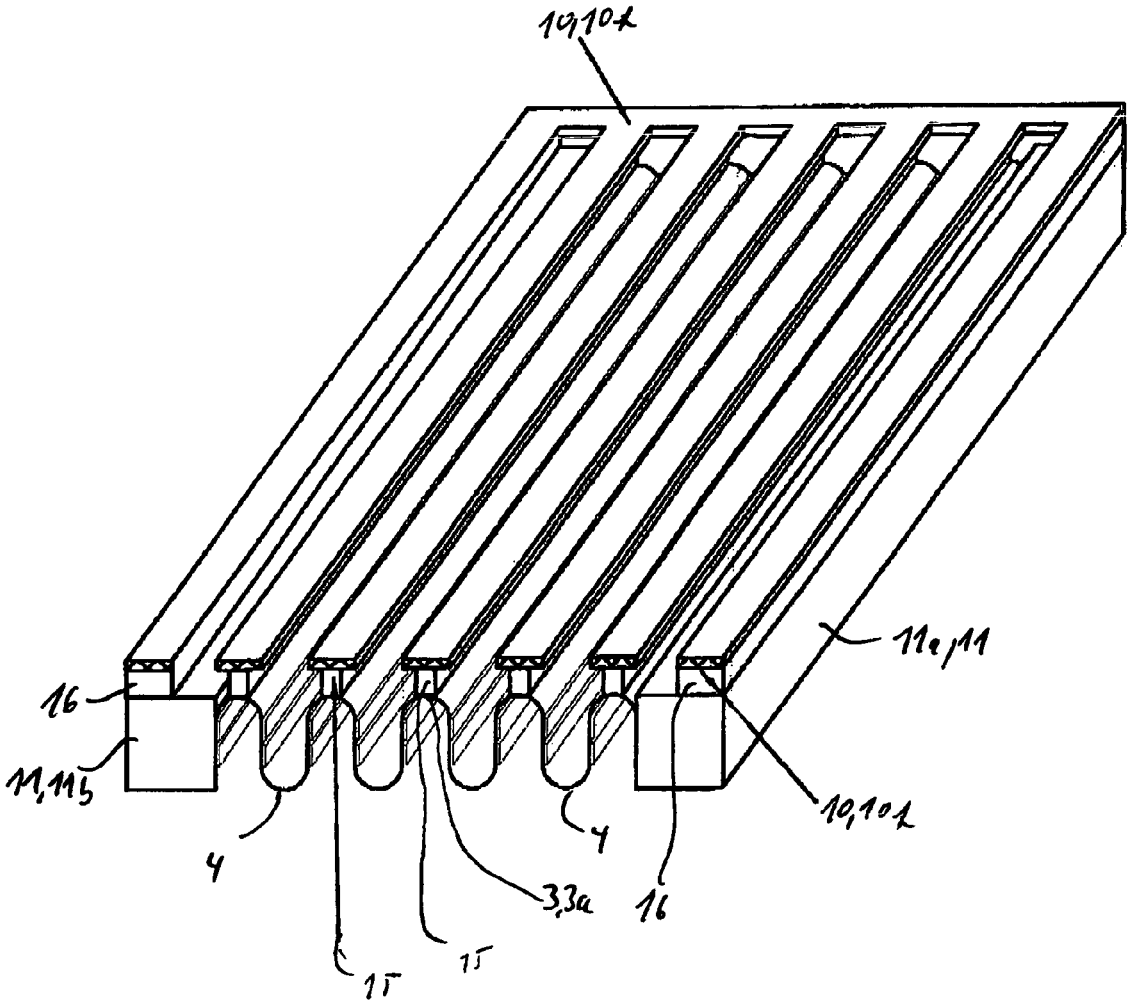
FIG. 19 shows a further exemplary embodiment of a membrane or membrane configuration according to the invention in a schematic perspective illustration.
Figure 20:
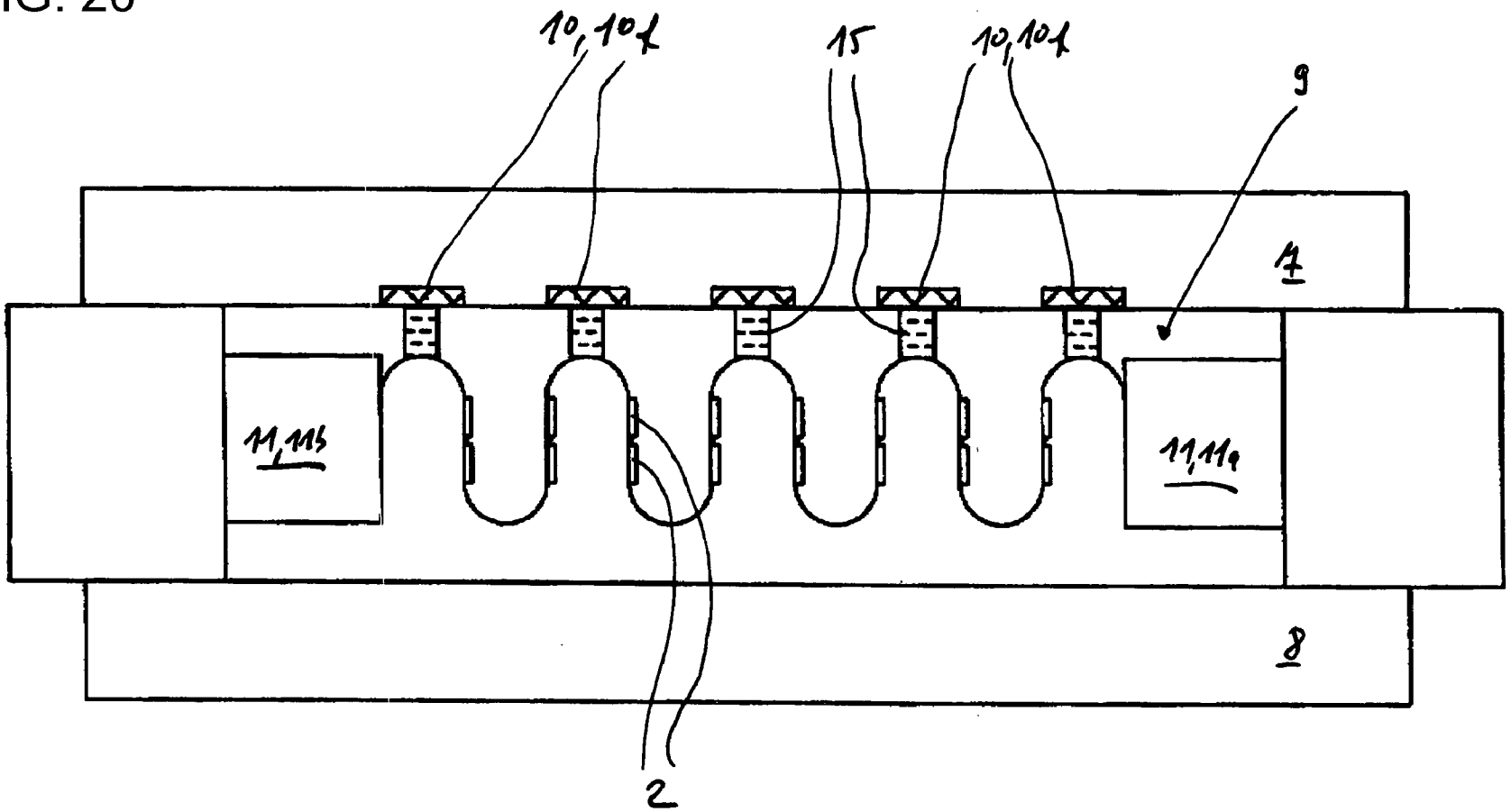
FIG. 20 shows the membrane or membrane configuration, illustrated schematically in FIG. 19, arranged between two pole plates in a schematic illustration from the side.

FIGS. 19 and 20 show a further embodiment of a support element 10; namely a support element 10*f* of a grid-shaped design, as illustrated clearly in FIG. 19. FIGS. 19 and 20 show that the grid-like support element 10*f* is preferably designed such that it has individual strip-shaped elements running substantially parallel to the corresponding wave crests 3. FIG. 20 shows that the grid-shaped support element 10*f* is then arranged in the region of a pole plate 7 such that the wave crests 3, in particular the wave crest tails 3*a*, can be or are connected to the grid-shaped support element 10*f* preferably by means of a thermally conducting adhesive and/or plastic.

FIG. 19 shows the arrangement of the grid-shaped support element 10*f* with the adhesive region or the plastic region 15 by means of which the grid-shaped support element 10*f* is in this case connected to the wave crests 3. The grid-shaped support element 10*f* is preferably likewise produced from a thermally conducting material.

FIGS. 19 and 20 show that corresponding spacers 16 are also provided on the frame parts 11*a* and 11*b* in order to implement the arrangement according to FIG. 20; in particular, the pole plate 7 also has recesses (not referenced individually in any more detail in this case) in which the grid-shaped support element 10*f* can be arranged or in which it can be adhesively bonded. It is of course also feasible for a second additional support element to be provided not only at the pole plate 7 but also in the region of the pole plate 8 for the wave troughs 4, but this is not illustrated here. Furthermore, the support element 10*f* can also be held on the pole plate 7 by a magnetic force.

It can be seen that the membrane 1 according to the invention, and the described membrane configurations, can be used in different electrodynamic sound transducers, in particular in loudspeakers, microphones or the like.

The invention claimed is:

1. An air-motion-transformer loudspeaker, comprising:

two pole plates disposed to define an air gap therebetween;

a substantially meander-shaped membrane disposed in said air gap, said membrane having a plurality of flank sides and a plurality of wave crests and wave troughs, extending in a longitudinal direction of said membrane;

conductor tracks extending along said plurality of flank sides;

mutually opposing said flank sides delimiting air pockets and respectively opposing individual said flank sides moving towards and away from one another in a transverse direction of said membrane during an operation of the loudspeaker;

each said wave crest and each said wave trough being defined with an axial center line and each carrying one or more strip-shaped stiffening elements, said stiffening elements being disposed on said axial center lines and extending evenly in the longitudinal direction;

said stiffening elements being formed and disposed to cause said flank sides to move towards and away from one another while remaining parallel to one another and to cause the axial center lines of said wave crests and said wave troughs to retain an axial orientation in the longitudinal direction of said membrane during the operation of the loudspeaker, and to prevent non-parallel oscillations of said flank sides relative to one another and bending of said flank sides during the operation of the loudspeaker.

2. The loudspeaker according to claim 1, wherein said strip-shaped stiffening elements are strips disposed at a zenith of said wave crests and/or of said wave troughs.

3. The loudspeaker according to claim 2, wherein said strip-shaped stiffening elements are strips extending an entire length of said membrane.

4. The loudspeaker according to claim 1, wherein said strip-shaped stiffening elements are aluminum strips.

5. The loudspeaker according to claim 1, which further comprises a frame, and wherein said membrane is disposed in said frame.

6. The loudspeaker according to claim 1, wherein said stiffening elements are glued to said membrane by way of an adhesive and/or a plastic region forming a functionally effective connection.

7. An air-motion-transformer loudspeaker, comprising:

two pole plates disposed to define an air gap therebetween;

a substantially meander-shaped membrane disposed in said air gap, said membrane having a plurality of flank sides and a plurality of wave crests and wave troughs, extending in a longitudinal direction of said membrane;

conductor tracks extending along said plurality of flank sides;

mutually opposing said flank sides delimiting air pockets and respectively opposing said flank sides moving towards and away from one another in a transverse direction of said membrane during an operation of the loudspeaker;

a frame formed with lateral frame parts laterally framing said membrane;

a stabilizing element disposed to stabilize an axial alignment in the longitudinal direction of said wave crests and said wave troughs during the operation of the loudspeaker;

said stabilizing element being configured as a strip-shaped support element for functionally effectively connecting mutually adjacent wave crests or mutually adjacent wave troughs, along a transverse direction of said membrane, and said lateral frame parts of said frame;

said support element being configured at least partially elastic and disposed to prevent a lateral non-parallel oscillation of said side flanks relative to one another and bending of said flank sides during the operation of the loudspeaker.

8. The loudspeaker according to claim 7, wherein said stabilizing element is configured and disposed to assure that individual said flank sides move precisely parallel toward or away from one another during an operation of the loudspeaker and said wave crests and the wave troughs, namely the axial alignment of the wave crest tails or the wave trough tails, substantially maintain a positional alignment thereof during the operation of the loudspeaker.

9. The loudspeaker according to claim 7, wherein said support element is configured and disposed such that said wave crests and/or wave troughs, lying adjacent to one another in the transverse direction of said membrane, and said lateral frame parts are connected to each other in a functionally effective fashion.

10. The loudspeaker according to claim 7, wherein said support element is at least partially elastic.

11. The loudspeaker according to claim 7, wherein said support element is at least partly formed as a web.

12. The loudspeaker according to claim 7, wherein said support element is at least partly formed of screen or linen.

13. The loudspeaker according to claim 7, wherein said support element is glued to said membrane by way of an adhesive and/or a plastic region forming a functionally effective connection.

14. The loudspeaker according to claim 7, wherein said support element is glued to said membrane and to said frame by way of spacers.

* * * * *